US005094391A

United States Patent [19]

Tamashige et al.

[11] Patent Number: 5,094,391

[45] Date of Patent: Mar. 10, 1992

[54] PNEUMATIC CLASSIFIER

[75] Inventors: Takamiki Tamashige; Mitsuhiro Ito; Hiroaki Tanaka; Hiroyuki Ninomiya; Takeshi Furukawa; Ryosuke Narishima, all of Tokyo; Satoru Fujii, Onoda, all of Japan

[73] Assignee: Onoda Cement Co., Ltd., Onoda, Japan

[21] Appl. No.: 597,443

[22] Filed: Oct. 15, 1990

[30] Foreign Application Priority Data

Oct. 20, 1989 [JP] Japan ..... 1-273353

[51] Int. Cl.[5] ..... B02C 13/24; B02C 13/286

[52] U.S. Cl. ..... 241/79.1; 241/188 A

[58] Field of Search ..... 241/275, 188 A, 79.1, 241/152 A

[56] References Cited

U.S. PATENT DOCUMENTS 2,199,015 4/1940 Toensfeldt ..... 241/188 A X 4,296,864 10/1981 Misaka et al. .

FOREIGN PATENT DOCUMENTS 275514 6/1914 Fed. Rep. of Germany ... 241/188 A 437292 11/1926 Fed. Rep. of Germany ... 241/188 A 160934 5/1964 U.S.S.R. ..... 241/188 A 1375320 2/1988 U.S.S.R. ..... 241/79.1

1375321 2/1988 U.S.S.R. ..... 241/79.1

OTHER PUBLICATIONS

Japanese Publication: Harp-Shaped Micro-Plex.

*Primary Examiner*—Mark Rosenbaum

*Attorney, Agent, or Firm*—Price, Heneveld, Cooper, DeWitt & Litton

[57] ABSTRACT

A pneumatic classifier having a dispersion chamber with crushing function disposed between a material supply port and a classifying chamber so that the material is sufficiently crushed and dispersed before entering the classifying chamber.

4 Claims, 4 Drawing Sheets

PNEUMATIC CLASSIFIER

BACKGROUND OF THE INVENTION

1. Field of the Invention

The present invention relates to a pneumatic classifier and, more particularly, to a pneumatic classifier which can classify granular and/or powder materials at high efficiency.

2. Description of the Related Art

Pneumatic classifiers have been widely known in which granular or powdered material such as powdered limestone is dispersed by flow of air and classified into coarse grains and fine grains by the balance between centrifugal force and counter-centrifugal force, the fine grains being then suspended by the flow of air and discharged to the exterior of the classifier casing together with the air.

When the material to be treated has a large agglomeration force, the components of the material which are to be collected as fine grains are undesirably discharged as coarse grains because such components form comparatively large grains due to agglomeration. This is one of the factors which impair the classification performance.

This means that the classification efficiency can appreciably be improved if the agglomerates are dispersed into fine grains.

Various methods have been known for enhancing dispersion of the agglomerates. For instance, in a first method, the material is dispersed by means of an ejector which operates with compressed air. In a second method, granular material suspended in the air is made to pass through a restricted slit so as to enhance the dispersion.

These known methods for enhancing the dispersion, however, suffer from the following problems.

Namely, the first method requires a large power, as well as a complicated construction of the classifier.

In the second method, there is a risk that the slit is blocked or clogged with grits of grain sizes around 10 mm or so, particularly when the material to be classified is rich in grits. This problem is serious particularly in closed-loop crushing process in which the material is recirculated at a high recirculation ratio, because in such a case a large quantity of granular material containing grits is to be treated. To eliminate this problem, it is necessary to employ suitable means for removing grits such as primary classification.

Furthermore, both these known methods inevitably suffer from a problem in that the granular material which has been dispersed undesirably reaggregate in transportation so as to impair the classification efficiency.

The current cement industry often employs twin-roll type pre-crushing machine for cement clinker. In order to attain a high crushing efficiency, a very high pressure is applied to the clinker so that the clinker is crushed by a very high pressure so as to become hard flakes and lumps. In order to further crush such flakes and lumps, devices such as a ball mill or a hammer mill is disposed downstream of the roll type crusher. The whole system will be remarkably facilitated if the classifier is provided with a function for crushing such flakes and lumps in place of the ball mill or the hammer mill. Such a simplified system will reduce installation cost and power consumption.

SUMMARY OF THE INVENTION

Accordingly, an object of the present invention is to provide a pneumatic classifier having a simple construction and capable of operating with a high efficiency.

Another object of the present invention is to provide a pneumatic classifier which has a function for crushing flakes and lumps discharged from a roll-type crusher of a high-pressure crushing system, thus eliminating necessity for a crushing mill such as a ball.

To these ends, according to the invention, the agglomerates or lumps of the material supplied to a dispersion chamber of a classifier are crushed into primary grains by a material crushing means and then dropped into a classifying chamber.

DESCRIPTION OF THE PREFERRED EMBODIMENTS

Figure 1:
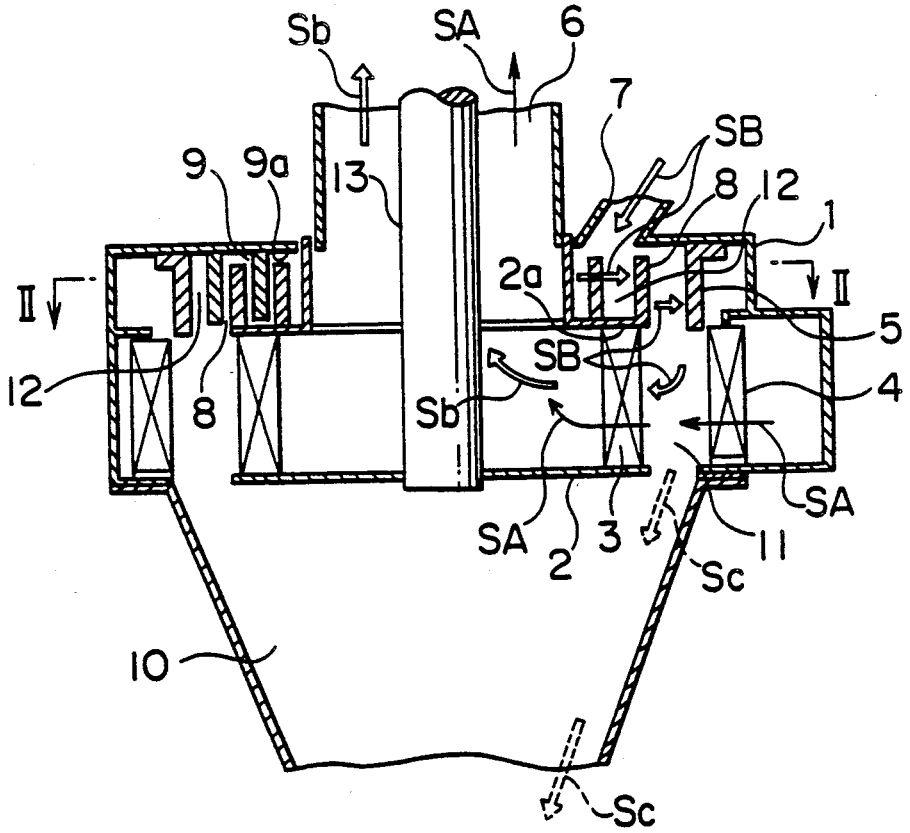
FIG. 1 is a vertical sectional view of an embodiment of the present invention.

Preferred embodiments of the present invention will be described with reference to the accompanying drawings. Throughout the drawings, the same reference numerals are used to denote the same parts or members having the same functions.

Referring to the drawings, a casing 1 encases a rotor 2 which is fixed to a rotor shaft 13 and which carries classifying blades 3. The casing 1 is provided with guide vanes 4 which radially oppose the classifying blades 3 across a classifying chamber 11.

The classifying chamber 11 communicates with the material supply port 7 through a dispersion chamber 12.

The dispersion chamber 12 is provided with a cylindrical dispersion plate 5, and rotor-side crushing portion 8 and a casing-side crushing portion 9 which are disposed inside the plate 5.

Figure 2:
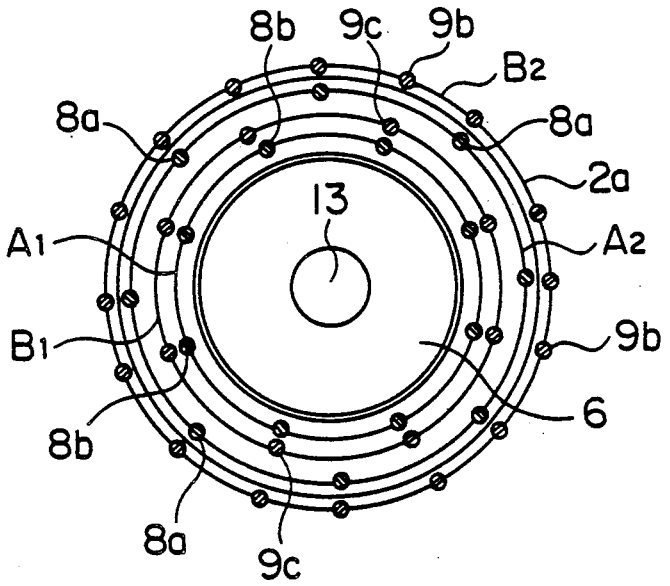
FIG. 2 is a sectional view taken along the line II—II of FIG. 1.

As shown in FIG. 2, a plurality of pins **8*a* and 8*b* are arranged at intervals on the upper surface 2*a* of the rotor 2 of the rotor-side crushing portion 8 along concentric circles $A_1$ and $A_2$. Furthermore, a plurality of pins 9*b*, 9*c* are arranged at intervals on the inner surface 9*a* of the casing-side crushing portion 9** along circles $B_1$ and $B_2$ which are concentric with the aforementioned circles $A_1$ and $A_2$.

The number of the pins **8*b* on the circle $A_1$ is the same as that of the pins 9*c* on the circle $B_1$. The number of the pins 8*a* on the circle $A_2$ is smaller than the number of the pins 9*b* on the circle $B_2$. The ratio of the number of the pins 8*a* to the number of the pins 9*b*** is, for example 2:3.

Figure 3:
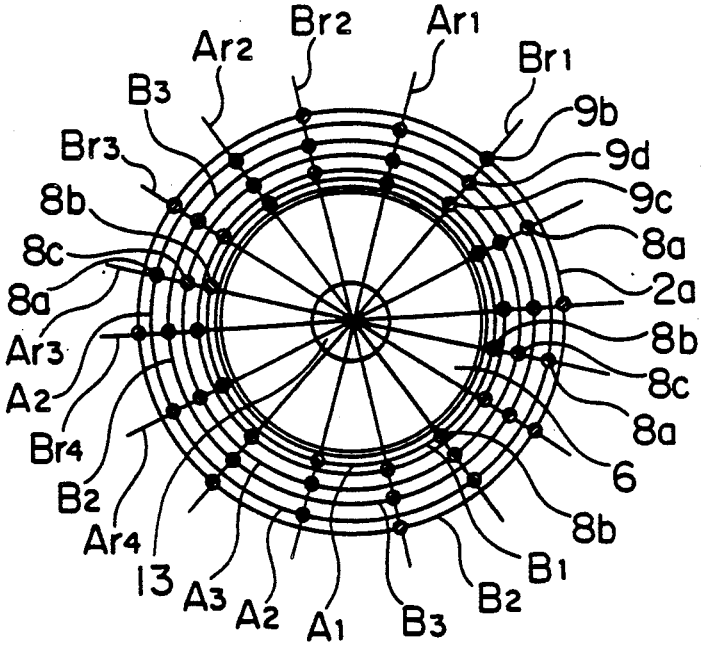
FIG. 3 is a sectional view of another embodiment.

Briefly, what is required is that the pins **8*a*, 8*b*, 9*b* and 9*c* are arranged so as to form a pin mill. Thus, the arrangement of these pins may be modified in various manners. For instance, the arrangement may be such that, as shown in FIG. 3, radially-spaced pins 8*a*, 8*b* and 8*c* and radially spaced pins 9*b*, 9*c* and 9*d*** are respectively arranged on straight lines $Ar_1$ to $Ar_4$ and $Br_1$ to $Br_4$ which pass the center O of the concentric circles $A_1$ to $A_3$ and $B_1$ to $B_3$.

The operation of the first embodiment will be described hereinunder.

Classifying air SA is introduced into classifying chambers 11 through the guide vanes 4 so as to form free vortex flow in the classifying chamber 11. At the same time, the rotor shaft 13 is driven to rotate the classifying blades 3 so as to form forcible vortex flow. Consequently, these vortex flow components are discharged from a fine grain discharge duct 6 through the gaps between the classifying blades 3 after making swirl in the classifying chamber 11. A material SB to be classified, such as calcium carbonate, is supplied through a material supply port 7, so that the material SB drops into the dispersion chamber 12.

Comparatively fine secondary agglomerate grains, as well as coarse grains, of the material SB are crushed and pulverized into fine primary grains by the action of the pin mill formed by the pins arranged in the dispersion chamber 12. By the combination of these effects, fine secondary agglomerate grains depositing to the surfaces of the coarse grains also are dispersed into fine primary grains. The fine primary grains then collide with the cylindrical dispersion plate 5 so as to be deflected to fall into the classifying chamber 11.

In this classifying chamber 11, the grains are classified into fine grains Sb and coarse grains Sc by the balance between the centrifugal force and the resistance produced by the air.

The fine grains Sb thus obtained through classification have grain sizes which are not greater than 5 μm. These fine grains are then suspended by upward flow of air so as to be introduced into the fine grain discharge duct 6 through the opening in the rotor 2 and are collected by an air filter which is not shown.

Meanwhile, the coarse grains are made to swirl in the casing 1 so as to be discharged from the coarse grain discharge duct 10.

Figure 4:
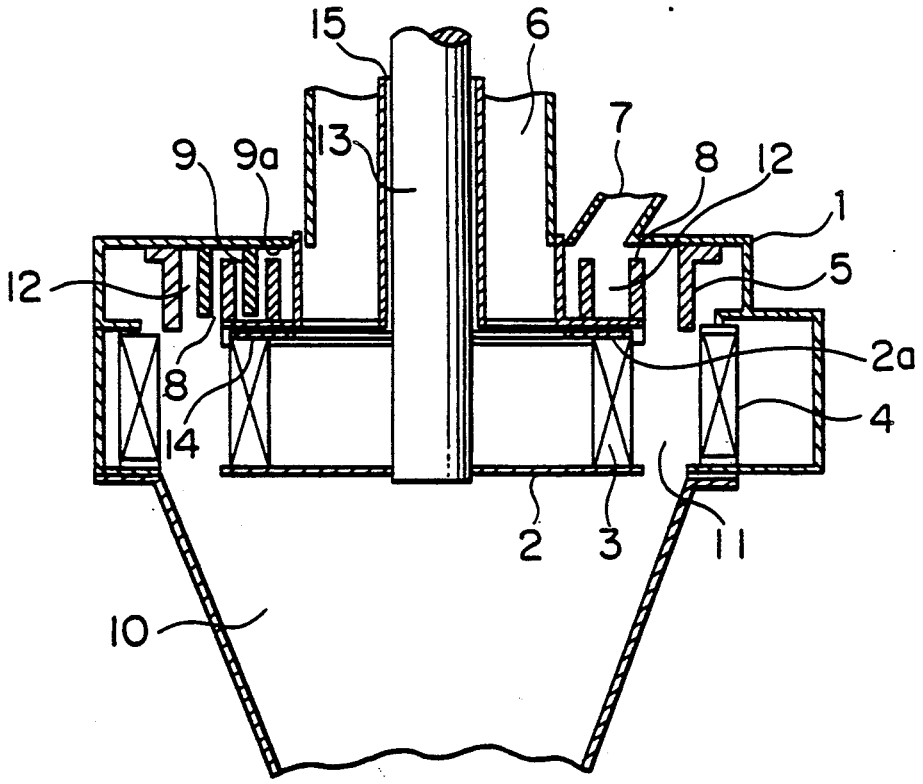
FIGS. 4 and 5 are vertical sectional views of different embodiments.

The described embodiment is not exclusive. FIG. 4 shows another embodiment in which the pin mill, which is formed in the described embodiment by pins formed on the upper surface 2*a* of the rotor 2 integrally therewith, is constituted by a pin mill disk 14 which is provided with pins 8*a* to 8*c*. The disk 14 is fixed to a first rotor shaft 15 which loosely fit on the second rotor shaft 13. In operation, the rotor 2 and the pin mill disk 14 are rotated independently of each other. According to this arrangement, the rotation speed of the pin mill disk 14 can be adjusted independently of the speed of the rotor 2. By elevating the rotation speed of the pin mill disk 14, it is possible to crush and disperse even flakes or lumps of material which are difficult to crush, thus attaining a further improvement in the classification efficiency.

Figure 5:
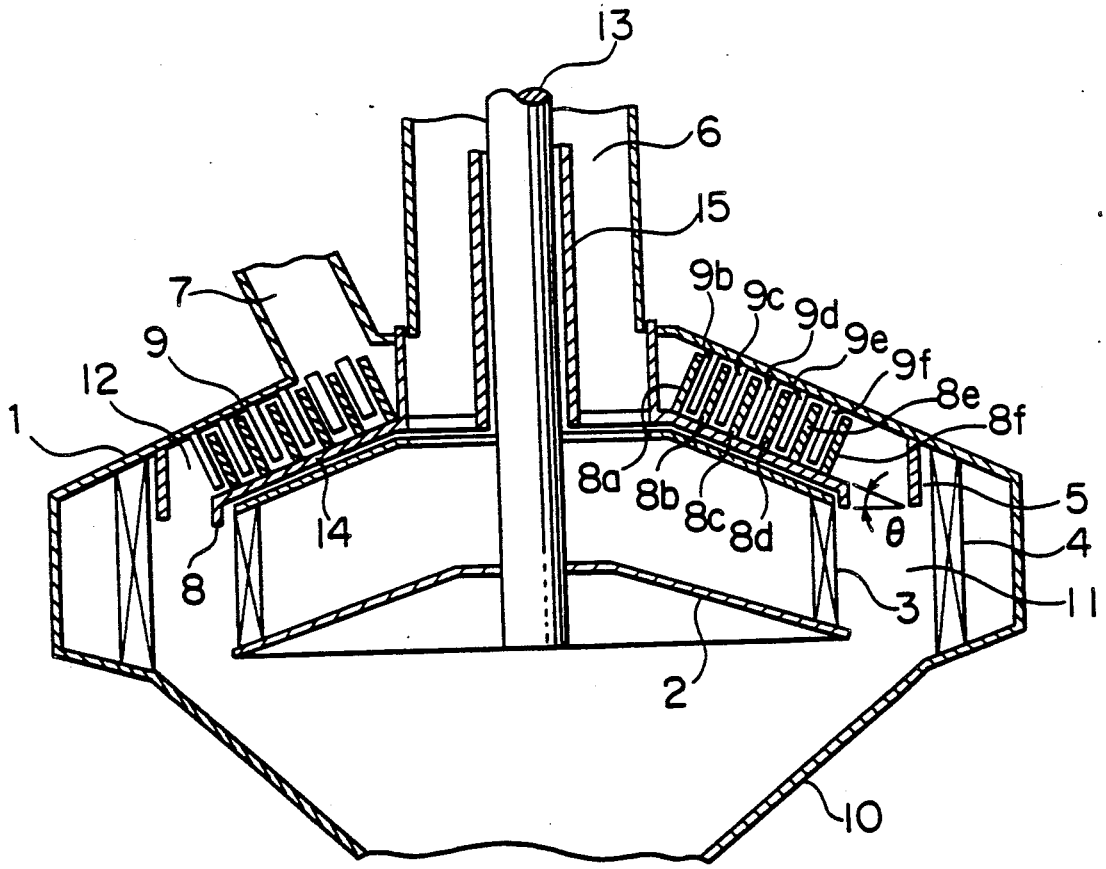

FIG. 5 shows a different embodiment in which the pin mill disk 14 is conically tapered so as to extend radially outwardly and downwardly, instead of being flat. The angle $\theta$ of the taper may be changed as desired but may be determined to be, for example, 30°.

The conically-shaped pin disk mill 14 provides a greater area for the installation of the pins and facilitates dropping of the material. It is therefore possible to attain a higher classification efficiency.

Although the operation of the pneumatic classifier for classifying ordinary grain material has been described, the pneumatic classifier of the present invention can equally be applied to processing of flakes and lumps of cement clinker discharged from a roll-type crusher of a crushing system. Such flakes and lumps are effectively crushed and pulverized by the pin mill so as to be classified at a high efficiency.

As has been described, the pneumatic classifier of the present invention features a dispersion chamber equipped with a material crushing means. The material put into the classifier is introduced into the dispersion chamber in which comparatively fine secondary agglomerate grains and coarse grains are simultaneously crushed and pulverized to provide a multiplied effect to disperse the material into fine primary grains which are introduced into the classifying chamber.

Thus, the material is crushed into fine grains which are easy to classify when entering the classifying chamber, so that pneumatic dispersion in the dispersion chamber can be effected at a high efficiency. In addition, the pneumatic classifier of the invention can be applied also to classification of hard flakes of cement clinker discharged from a roll-type crusher.

What is claimed is:

1. A pneumatic classifier comprising:

a cylindrical casing having opposed ends interconnected by a circumferential wall, one end of said casing having an inner surface, a material supply port therethrough and a fine grain discharge duct interconnected therewith and communicating with the interior of said casing, said other end of said casing having a coarse grain discharge duct interconnected therewith, said coarse grain discharge duct also communicating with the interior of said casing;

a rotor shaft passing through said fine grain discharge duct and into said casing;

a rotor positioned within said casing and affixed to said shaft for rotation therewith, said rotor having an upper surface nearest to said one end, said rotor and said shaft oriented such that their axis of rotation is parallel to the cylindrical axis of said casing;

a plurality of radially outward extending classifying blades affixed to the outer periphery of said rotor and a plurality of radially inward extending stationary guide vanes affixed to the inner periphery of said circumferential wall, said blades and vanes defining therebetween a classifying chamber;

a plurality of pins projecting from said upper surface of said rotor towards said one end;

a plurality of opposing pins projecting from said inner surface of said one end, said pins alternatingly positioned such that the projecting ends of said plurality of pins affixed to said one end extend past the ends of opposingly projecting plurality of pins affixed to said upper surface of said rotor, said opposing pins forming a pin mill for grinding material entering said casing through said material supply port when said rotor is rotated; and a cylindrical dispersion plate extending from said inner surface of one end, said plate and said pin mill defining therebetween a dispersion chamber.

2. A pneumatic classifier comprising:

a cylindrical casing having opposed ends interconnected by a circumferential wall, one end of said casing having an inner surface, a material supply port therethrough and a fine grain discharge duct interconnected therewith and communicating with the interior of said casing, said other end of said casing having a coarse grain discharge duct interconnected therewith, said coarse grain discharge duct also communicating with the interior of said casing;

a first rotatable rotor shaft having a hollow interior, said first shaft passing through said fine grain discharge duct and into said casing;

a second rotor shaft positioned within the interior of said first shaft, said second shaft passing through said fine grain discharge duct and into said casing;

a rotor positioned within said casing and affixed to said second shaft for rotation therewith, said rotor and said first and second shafts oriented such that their axis of rotation is parallel to the cylindrical axis of said casing;

a plurality of radially outward extending classifying blades affixed to the outer periphery of said rotor and a plurality of radially inward extending stationary guide vanes affixed to the inner periphery of said circumferential wall, said blades and vanes defining therebetween a classifying chamber;

a pin mill disk rotatably independent from said rotor, said pin mill disk concentrically oriented and attached to said first shaft such that said disk is positioned adjacent to an end of said plurality of classifying blades nearest to said one end;

a plurality of pins projecting from said pin mill disk towards said one end;

a plurality of opposing pins projecting from said inner surface of said one end, said pins alternatingly positioned such that the projecting ends of said plurality of pins affixed to said one end extend past the ends of opposingly projecting plurality of pins affixed to said pin mill disk, said opposing pins forming a pin mill for grinding material entering said casing through said material supply port when said first shaft is rotated; and a cylindrical dispersion plate extending from said inner surface of one end, said plate and said pin mill defining therebetween a dispersion chamber.

3. A pneumatic classifier according to claim 2, wherein said pin mill disk has a tapered surface extending radially outwardly and downwardly.

4. A pneumatic classifier according to claim 3, wherein the angle of taper of said pin mill disk is 30°.

* * * * *